US011612277B2

(12) United States Patent
Buell et al.

(10) Patent No.: US 11,612,277 B2
(45) Date of Patent: Mar. 28, 2023

(54) DISPENSERS AND DISPENSER SYSTEMS FOR SECURELY CONTROLLING A PLURALITY OF DOSE SIZES

(71) Applicant: GOJO Industries, Inc., Akron, OH (US)

(72) Inventors: Shelby J. Buell, Medina, OH (US); Mark A. Bullock, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 17/315,625

(22) Filed: May 10, 2021

(65) Prior Publication Data

US 2021/0353112 A1 Nov. 18, 2021

Related U.S. Application Data

(60) Provisional application No. 63/024,600, filed on May 14, 2020.

(51) Int. Cl.
*A47K 5/12* (2006.01)

(52) U.S. Cl.
CPC ..... *A47K 5/1217* (2013.01); *A47K 5/1202* (2013.01)

(58) Field of Classification Search
CPC ..... A47K 5/1217; A47K 5/1202
See application file for complete search history.

(56) References Cited

U.S. PATENT DOCUMENTS 4,868,373 A * 9/1989 Opheij ..... G06K 7/0021 235/380
7,611,030 B2 11/2009 Reynolds et al.
7,621,426 B2 11/2009 Reynolds et al.
7,837,066 B2 11/2010 Reynolds et al.
(Continued)

FOREIGN PATENT DOCUMENTS

EP 1671568 A2 * 6/2006 ..... A47K 5/1217
EP 1671568 A2 6/2006
(Continued)

OTHER PUBLICATIONS

International Search Report and Written Opinion from PCT/US2021/031496 dated Aug. 31, 2021.

*Primary Examiner* — Bob Zadeh
(74) *Attorney, Agent, or Firm* — Calfee, Halter & Griswold LLP

(57) ABSTRACT

An exemplary touch-free soap, sanitizer or lotion dispenser includes a housing, a movable cover, a processor, memory, a refill receptacle for receiving a refill container of fluid, and a variable output control card receptacle. The variable output control card receptacle is located proximate the refill receptacle such that when a refill unit is inserted in the refill receptacle, a variable output control card cannot be inserted or removed from the variable output control card receptacle. The dispenser further includes a reader for placing the processor in circuit communication with a variable output control card and in circuit communication with a refill unit data tag. In addition, the dispenser includes a sensor for sensing an object, a variable output control card and a removable and replaceable refill unit. The data tag is secured to the refill unit and the VOC card includes data on the variable output control card for setting the dispenser output volume.

45 Claims, 6 Drawing Sheets

(56) References Cited

U.S. PATENT DOCUMENTS

| | | | | |
|---|---|---|---|---|
| 7,909,209 | B2 | 3/2011 | Reynolds et al. | |
| 8,302,812 | B2 | 11/2012 | Reynolds | |
| 8,955,718 | B2 | 2/2015 | Ciavarella et al. | |
| 8,960,498 | B2 | 2/2015 | Wegelin et al. | |
| 9,172,266 | B2 | 10/2015 | Curtis et al. | |
| 9,357,887 | B2 | 6/2016 | Wegelin et al. | |
| 9,943,196 | B2 | 4/2018 | Mak et al. | |
| 10,065,199 | B2 | 9/2018 | Twaroski et al. | |
| 10,080,466 | B2 | 9/2018 | Ciavarella et al. | |
| 10,080,467 | B2 | 9/2018 | Ciavarella et al. | |
| 10,080,468 | B2 | 9/2018 | Ciavarella et al. | |
| 10,143,339 | B2 | 12/2018 | Ciavarella et al. | |
| 10,149,575 | B2 | 12/2018 | Fojek et al. | |
| 10,459,460 | B2 | 10/2019 | Carlson | |
| 2006/0231568 | A1* | 10/2006 | Lynn | A47K 5/1202 222/52 |
| 2006/0243740 | A1* | 11/2006 | Reynolds | A47K 5/1208 222/52 |
| 2009/0204256 | A1* | 8/2009 | Wegelin | G01F 13/00 700/244 |
| 2010/0006597 | A1* | 1/2010 | Reynolds | A47K 5/1208 222/41 |
| 2010/0230435 | A1* | 9/2010 | Wegelin | G07C 9/37 340/5.82 |
| 2011/0082595 | A1* | 4/2011 | Mehus | B67D 7/02 700/283 |
| 2012/0218106 | A1* | 8/2012 | Zaima | H04W 4/027 340/540 |
| 2013/0094983 | A1* | 4/2013 | Pelfrey | A47K 5/14 417/472 |
| 2014/0234140 | A1* | 8/2014 | Curtis | H02J 7/345 417/411 |
| 2014/0266575 | A1* | 9/2014 | Pelfrey | A47K 5/1217 340/5.2 |
| 2015/0199883 | A1 | 7/2015 | Hartley et al. | |
| 2015/0223646 | A1* | 8/2015 | Wegelin | A47K 5/1217 222/1 |
| 2016/0214817 | A1* | 7/2016 | Borke | G05B 15/02 |
| 2017/0049276 | A1 | 2/2017 | Lightner et al. | |
| 2017/0229002 | A1* | 8/2017 | Wegelin | A47K 5/1211 |
| 2017/0336244 | A1* | 11/2017 | Moore | B65D 83/0005 |
| 2019/0063980 | A1* | 2/2019 | Kobs | G01F 23/265 |
| 2019/0133384 | A1 | 5/2019 | Mcnulty et al. | |
| 2021/0353112 | A1* | 11/2021 | Buell | A47K 5/1202 |

FOREIGN PATENT DOCUMENTS

| | | | | |
|---|---|---|---|---|
| JP | 2017518550 | * | 7/2017 | G06Q 20/208 |
| WO | 2004086731 | A2 | 10/2004 | |

* cited by examiner

DISPENSERS AND DISPENSER SYSTEMS FOR SECURELY CONTROLLING A PLURALITY OF DOSE SIZES

RELATED APPLICATIONS

The present application claims priority to, and the benefits of, U.S. Provisional Patent Application Ser. No. 63/024,600, titled DISPENSERS AND DISPENSER SYSTEMS FOR SECURELY CONTROLLING A PLURALITY OF DOSE SIZES, filed on May 14, 2020, and which is incorporated herein by reference in its entirety.

TECHNICAL FIELD

The present invention relates generally to touch free soap and sanitizer dispenser systems and more particularly dispensers that have a secure system for changing the size of the dose that is dispense to the user.

BACKGROUND OF THE INVENTION

In hands-free (or touch-free) dispensers, a liquid or foam pump is typically activated by an actuator that drives the pump through a drive cycle to dispense a dose of fluid. The size or volume of fluid that is dispensed is generally set at the time of manufacture.

Typically touch-free dispensers utilize a sensing device, such as an infrared sensor that detects a user's hand and dispenses a dose of fluid onto the user's hands. The size of the dose of fluid that is dispensed is typically a standard volume that is set at the time of manufacture. Often times, it is desirable to change or vary the standard volume of fluid that is dispensed from the dispenser.

In some cases, the standard volume is reduced. Various mechanical mechanisms have been utilized to reduce the standard volume, such as, for example, mechanical devices that cause "short stroking" of the pump. U.S. Pat. No. 8,955,718 titled, Foam Pump s with Lost Motion and Adjustable Output Foam Pumps discloses several mechanical mechanisms for changing the dose volume that is dispensed. These mechanical mechanisms may be tampered with, removed or added, without the consent of the facility that is providing the dispenser. As the facility provider often has a reason for the set volume of the dose to be dispensed, such as, for example, the volume of the dose being set in accordance with hand sanitization guidelines, the facility provider does not want the dose sized changed without its knowledge.

In some cases, the volume is altered electronically, by for example, pressing a button on the dispenser, or moving a selector switch to a selectable setting. U.S. Pat. No. 8,302,812 titled Dispenser with Discrete Dispense Cycles discloses one method of altering the dose volume electronically by pressing one or more buttons that allows a user to alter the volume of fluid being dispensed. Allowing a user to determine how much fluid is dispensed, may cause a violation of the hand sanitation guidelines being followed by the facility. It may also result in waste. In addition, even if selectable volume switches are hidden, nefarious individuals may find the switches and change or alter the "standard" volume that is being dispensed.

In addition, in some dispenser systems, the dispenser reads information stored on a refill unit and uses that information to set the dispense volume. See for example, U.S. Pat. Nos. 10,459,460 and 9,357,887. The information stored on the refill unit is then used to set the volume of fluid to be dispensed for that dispenser going forward. A problem with this type of dispensing system is that if the facility has different areas that require different volumes of fluid to be dispensed the facility has to buy multiple different refill units and has to ensure that the right refill unit is placed in the right dispenser. Therefore, a need exists for a dispenser that that can securely have the dose volumes changed by the proper personnel and to limit nefarious individual's ability to change the volume of fluid being dispensed.

SUMMARY

Exemplary embodiments of touch-free soap, sanitizer or lotion dispensers for securely controlling a plurality of different volumes of fluid being dispensed. An exemplary touch-free soap, sanitizer or lotion dispenser includes a housing, a movable cover, a processor, memory, a refill receptacle for receiving a refill container of fluid, and a variable output control card receptacle. The variable output control card receptacle is located proximate the refill receptacle such that when a refill unit is inserted in the refill receptacle, a variable output control card cannot be inserted or removed from the variable output control card receptacle. The dispenser further includes a reader for placing the processor in circuit communication with a variable output control card and in circuit communication with a refill unit data tag. In addition, the dispenser includes a sensor for sensing an object, a variable output control card and a removable and replaceable refill unit. The data tag is secured to the refill unit and the VOC card includes data on the variable output control card for setting the dispenser output volume.

Another exemplary touch-free soap, sanitizer or lotion dispenser includes a housing, a movable cover, a processor, memory, a refill receptacle for receiving a refill container of fluid and a variable output control card receptacle. The variable output control card receptacle located proximate the refill receptacle such that when a refill unit is inserted in the refill receptacle, the variable output control card cannot be inserted or removed from the variable output control card receptacle. A reader for placing the processor in circuit communication with a variable output control card, a sensor for sensing an object and a variable output control card are also provided. Data on the variable output control card is used for setting the dispenser output volume. The variable output control remains in the dispenser when a refill unit is removed from the dispenser.

Yet another exemplary touch-free soap, sanitizer or lotion dispenser includes a housing, a movable cover, a processor, memory, a variable output control card receptacle, a card reader for placing the processor in circuit communication with a variable output control card, a refill receptacle for receiving a refill container of fluid and a sensor for sensing an object. The memory includes logic for causing the processor to read data from a variable output control card located in the variable output control card receptacle. In addition, the memory includes logic for causing the processor to set a dispenser output volume as a function of the data. When the refill unit is removed, the variable output control card remains with the dispenser.

An exemplary method of adjusting the output volume of a touch-free dispenser includes providing a touch-free dispenser that has a variable output control card receptacle, a card reader for reading data from the variable output control card, a receptacle for receiving a refill container, a cover, a processor, and memory. Logic is stored in the memory for causing the processor to read data from a variable output control card. Logic is also stored in the memory for setting a dispenser output volume as a function of the data read from the variable output card. The method further comprises providing a refill unit and providing a variable output control card to be inserted in the variable output control card receptacle. The variable output card is separate from the refill unit and wherein the variable output card remains in the dispenser when the refill unit is removed from the dispenser. The method further includes causing a reader to read data from the variable output control card and causing the output volume of the dispenser to be set as a function of the data read from the variable output control card.

Another exemplary touch-free dispenser includes a housing, a processor; dispenser memory, a refill receptacle for receiving a refill container of fluid, and a removable and replaceable refill unit having a data tag secured thereto, wherein the data tag comprises data tag memory. A variable output control card receptacle, a variable output control card, variable output control card memory located on the variable output control card, one or more readers for placing the processor in circuit communication with the variable output control card memory and in circuit communication with the refill unit data tag memory, and a sensor for sensing an object are also included. The data on the variable output control card memory is used to set the dispenser output volume irrespective of a dispenser output volume stored in the data tag memory.

Another exemplary touch free dispenser includes a processor, dispenser memory, a refill receptacle for receiving a refill container of fluid, a variable output control card receptacle, a variable output control card and variable output control card memory located on the variable output control card. A reader for placing the processor in circuit communication with a variable output control card and a sensor for sensing an object are also provided. Data on the variable output control card is used for adjusting the dispenser output volume, and the variable output control remains in the dispenser when a refill unit is removed from the dispenser.

Another touch-free soap, sanitizer or lotion dispenser includes a processor, memory, logic stored in the memory for causing a default dispense dose volume to be dispensed upon actuation of the dispenser, a variable output control card receptacle, a card reader for placing the processor in circuit communication with a variable output control card, a refill receptacle for receiving a refill container of fluid and a sensor for sensing an object. The dispenser further includes logic stored in the memory. The logic causes the processor to read data from a variable output control card memory when a variable output control card is located in the variable output control card receptacle. Additional logic for causing the processor to set a dispenser output volume as a function of the data read from a variable output control card and to override the default dispense dose volume is also included. In addition, when the refill unit is removed from the dispenser the variable output control card remains with the dispenser.

Another exemplary methodology or logic for adjusting the output volume of a touch-free dispenser includes providing a touch-free dispenser that has a variable output control card receptacle, a card reader for reading data from the variable output control card, a receptacle for receiving a refill container, a processor, dispenser memory, logic stored in the dispenser memory for setting a first dispenser output volume. The methodology further comprises providing a refill unit, inserting a variable output control card in the variable output control card receptacle, wherein the variable output card is separate from the refill unit and wherein the variable output card remains in the dispenser when the refill unit is removed from the dispenser. In addition, the methodology includes causing the processor to read data from a variable output control card and causing a second dispenser output volume to be set as a function of the data read from the variable output card that is different than the first dispenser output volume.

BRIEF DESCRIPTION OF THE DRAWINGS

These and other features and advantages of the present invention will become better understood with regard to the following description and accompanying drawings in which.

DETAILED DESCRIPTION

Figure 1:
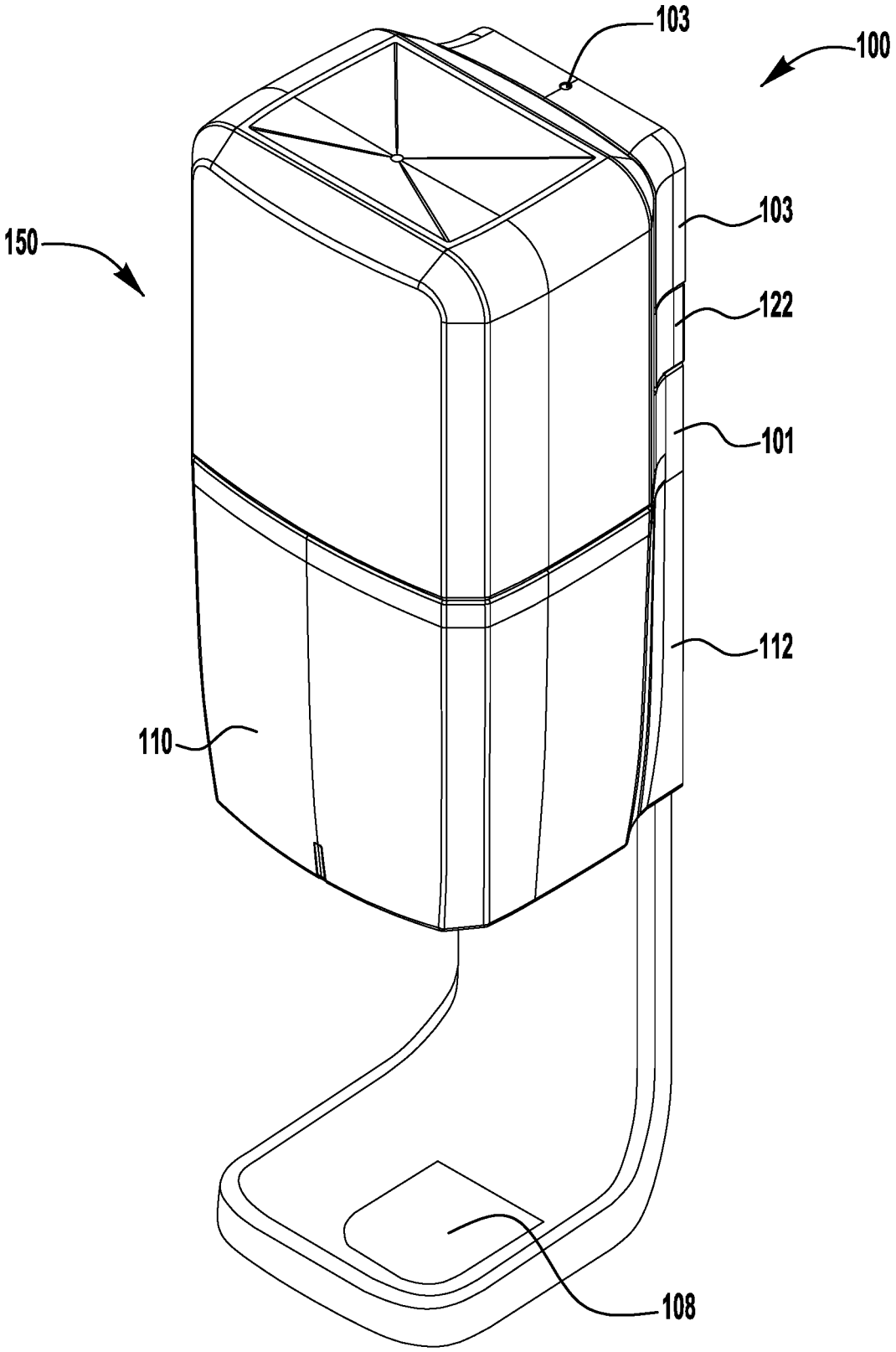
FIG. 1 is a perspective view of an exemplary dispenser with a refill unit installed and the cover closed.

The following includes definitions of exemplary terms used throughout the disclosure. Both singular and plural forms of all terms fall within each meaning. Except where noted otherwise, capitalized and non-capitalized forms of all terms fall within each meaning.

"Circuit communication" as used herein indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

Also, as used herein, voltages and values representing digitized voltages are considered to be equivalent for the purposes of this application, and thus the term "voltage" as used herein refers to either a signal, or a value in a processor representing a signal, or a value in a processor determined from a value representing a signal.

"Signal", as used herein includes, but is not limited to one or more electrical signals, analog or digital signals, one or more computer instructions, a bit or bit stream, or the like.

"Logic," synonymous with "circuit" as used herein includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

Block diagrams or logic flow diagrams disclosed herein are exemplary and additional blocks or steps may be added to the exemplary logic diagrams or removed from the exemplary logic diagrams. In addition, blocks or steps from one logic diagram may be included in the other exemplary logic diagrams. Further, the blocks or steps may be performed in different orders than illustrated, unless noted otherwise.

Values identified in the detailed description are exemplary and they are determined as needed for a particular dispenser and/or refill design. Accordingly, the inventive concepts disclosed and claimed herein are not limited to the particular values or ranges of values used to describe the embodiments disclosed herein.

Figure 2:
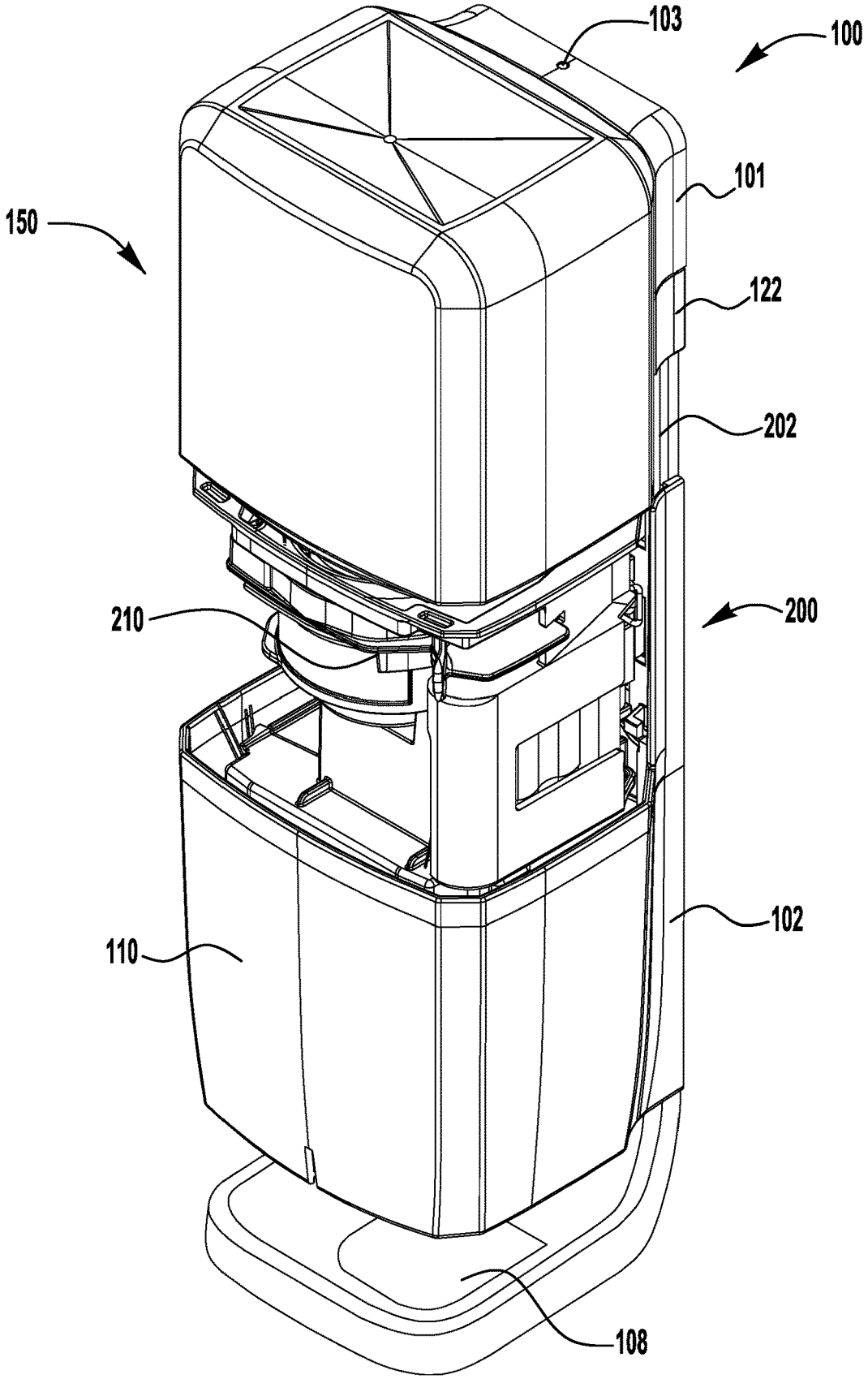
FIG. 2 is a perspective view of the exemplary dispenser of FIG. 1 with the cover opened.

FIG. 1 illustrates an exemplary dispenser 100 with a sliding cover 110. The exemplary dispenser 100 includes a base 101 that has two rails 202 (FIG. 2). The cover 110 secures to the rails 202 and slides up and down on the rails 202. The cover 110 slides between a closed position shown in FIG. 1 and an open position shown in FIG. 2. In some embodiments, the base 101 has only one rail 202. In other embodiments, the base 101 has more than two rails 202. Though the exemplary embodiment shows the cover 110 sliding downward when opened, in some embodiments the cover may slide upward, or to the side, or any other direction. In some embodiments, the cover may even be split into two or more portions, each sliding in a different direction when the cover is opened. In some embodiments, the cover 110 may be attached to base 101 with a hinge (not shown) and may swing open, from a side, the bottom or the top. In this exemplary embodiment, cover 110 covers a portion of refill unit 150 when it is closed. In some embodiments, cover 110 may completely enclose the refill unit 150.

Figure 3:
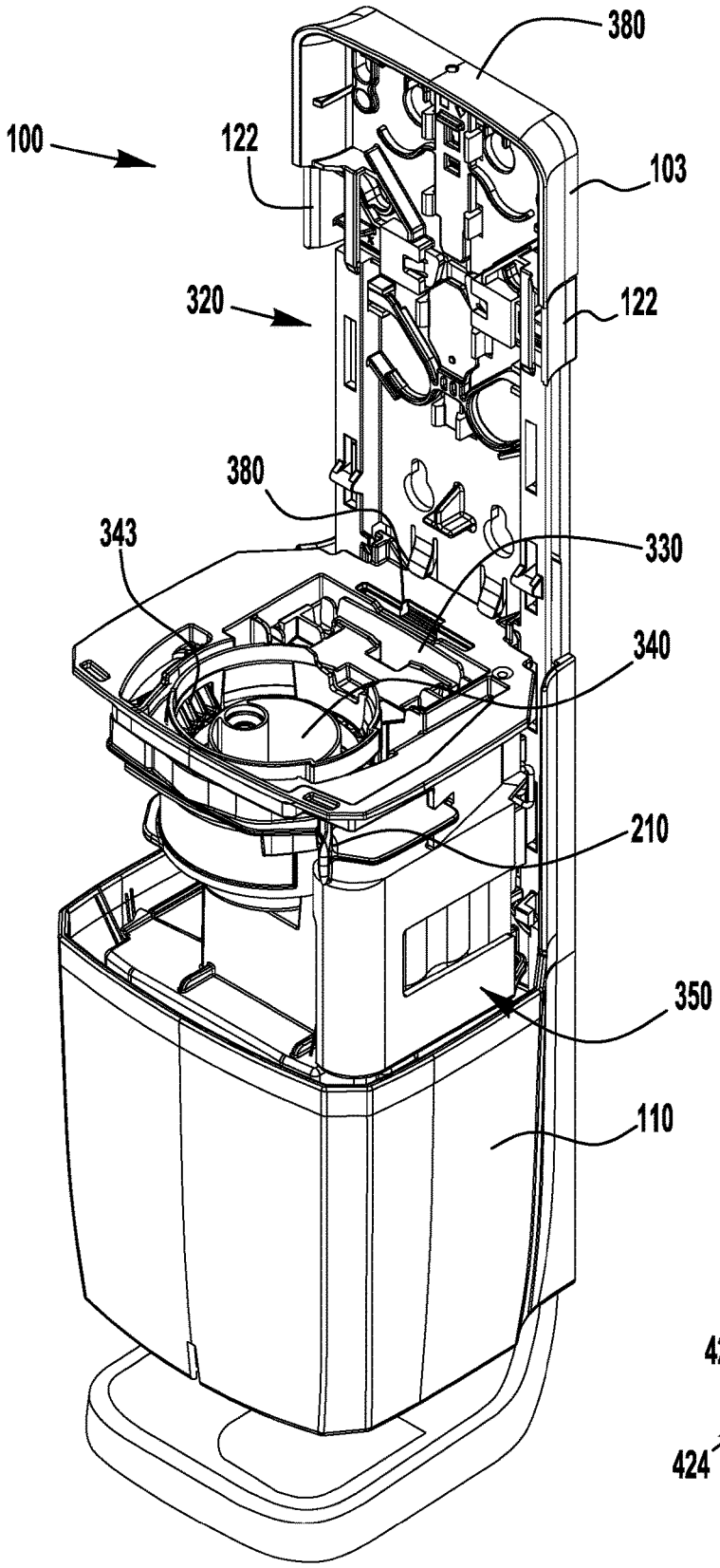
FIG. 3 is a perspective view of the exemplary dispenser of FIG. 1 with the refill unit removed, the cover open and without a Variable Output Control ("VOC") card being installed.
Figure 5:
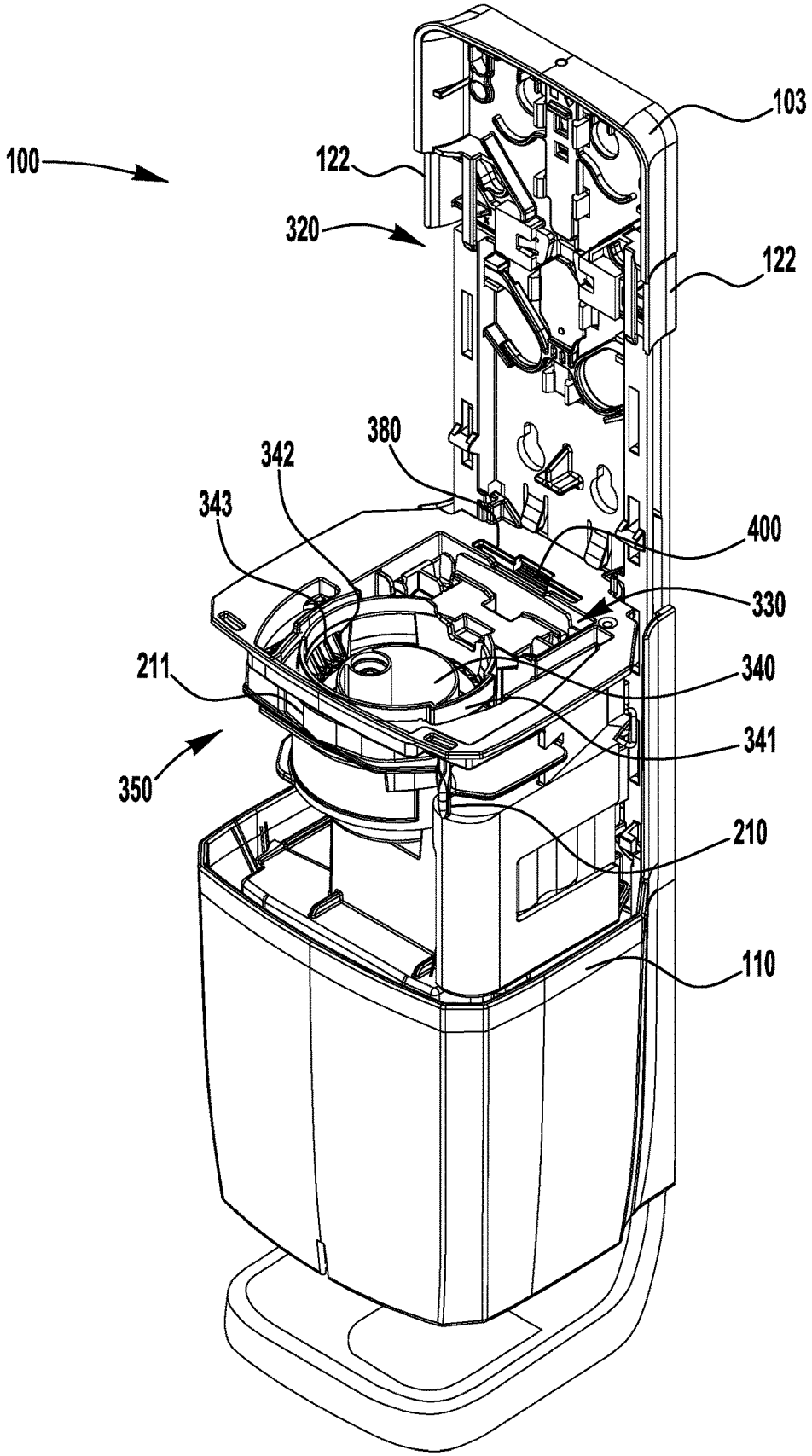
FIG. 5 is a perspective view of the exemplary dispenser of FIG. 1 with the refill unit removed, the cover open and a VOC card installed.

The dispenser 100 includes a latch 320 (FIGS. 3 and 5) that engages the cover 110 to lock cover 110 in a closed position. An exemplary latching mechanism is shown and described in U.S. Pat. No. 10,149,575, which is titled SLIDE OPEN REFILLABLE DISPENSER, and which is incorporated herein by reference in its entirety. The latch 320 is biased to remain closed, and is opened by pressing on an actuation member 122. The actuation member 122 is biased outward and releasing the actuation member 122 allows a bolt (not shown), which is part of latch 380, to move to a latched position. The bolt (not shown) retains the cover 110 in its closed position when the cover 110 is closed. Opening the latch moves the bolt (not shown) to an unlatched position and allows the cover 110 to slide downward to its open position. When open, the cover 110 can be closed with or without pressing one or both of actuation members 122. The latch 320 can be locked so it cannot be opened by pressing on the actuation members 122. In this exemplary embodiment, inserting a key (not shown) into a key aperture 380 in the base 101 locks the latch 320.

In some embodiments, a base cover plate (not shown) may be located proximate the top of the cover 110 when the cover 110 is in the closed position. In some embodiments, the base cover plate at least partially supports refill unit 150 which is at least partially received in the dispenser 100. When closed, the cover 110 and refill unit 150 conceal the base cover plate. Opening the cover 110 provides access so that a refill unit 150 can be installed in the dispenser 100. In this exemplary embodiment, a pump (not shown) is permanently installed in the dispenser 100 and refill unit 150 does not have a pump attached thereto. Refill unit 150 includes a mating member (not shown) that mates with the dispenser 100 to place the interior of the refill unit 150 in fluid communication with the pump (not shown). In some embodiments, when the refill unit 150 is installed in the dispenser 100, a pump (not shown) of the refill unit 150 is engaged by a drive unit (not shown) of the dispenser 100. The drive unit actuates the pump to dispense liquid or foam from the refill unit 150.

In this exemplary embodiment the refill unit 150 is inserted (and removed) along a vertical axis. A battery pod (not shown) located on refill unit 150 engages a battery receptacle 330 of the dispenser 100. The cover 110 is then closed and it covers at least a portion of the refill unit 150. The cover 110 prevents the refill unit 150 from being removed when the cover 110 is closed. In some embodiments, the cover covers the pump (not shown) and/or an outlet (not shown) of a refill unit 150. In some embodiments, the cover 110 covers the entire refill unit 150, including a container 152. In some embodiments, the cover 110 covers a portion of the refill unit. In some embodiments, refill unit 150 includes a container and a closure (not shown), and the closure and a portion of the container are covered by the cover 110. Preferably the latch 320 is covered by a base plate (not shown) that covers the latch 320 mechanisms as shown in U.S. Pat. No. 10,149,575.

The cover 110 includes slides 112 that engage the rails 202 of the base 101 and allow the cover 110 to slide between the closed (FIG. 1) and open position (FIG. 2). When cover 110 is in the open position, release member 210 is accessible. Release member 210, which is attached to release ring 211 rotates clockwise and causes one or more retainers 343 to retract. In this exemplary embodiment, receptacle 340, which receives at least a portion of refill unit 150, includes a cylindrical collar 341 secured to dispenser 100. Cylindrical collar 341 includes one or more apertures 342. One or more retainers 343 are connected to release ring 211 and protrude through the one or more apertures 342. In this exemplary embodiment, the one or more retainers are made of a resilient material, and in this exemplary embodiment are made up of two or more resilient fingers. As release ring 211 is rotated, the two or more resilient fingers rotate along with it, and deflect when they contact the sides of the one or more apertures 342. Because the resilient fingers are resilient, when they deflect, they bias the release ring 211 in the opposite direction. When the one or more retainers 343 extend through the one or more apertures 342, the one or more retainers 343 engage one or more catches (not shown) on the refill unit 150 to retain the refill unit 150 in place. To remove the refill unit 150, a user engages release member 210 and rotates release ring 211 clock-wise. Rotating release ring 211 clockwise causes one or more release members 343 to deflect and disengage with the one or more catches (not shown) on refill unit 150, which can then be lifted up and removed.

In some embodiments, the release member 210 and release ring 211 are biased in the counter-clockwise direction, by a biasing device, such as, for example, a spring, in which the one or more retainers 343 are configured to engage the one or more catches (not shown). In this exemplary embodiment, the refill unit 150 is lowered down in a vertical direction to be installed in dispenser 100. In this exemplary embodiment, refill unit 150 includes a power pod or battery (not shown) that engages with connector 330 to transfer power from the power pod to the dispenser 100. Refill unit 150 cannot be removed from dispenser 100 without rotating release member 210 and thus release ring 211. In some embodiments, a refill unit 150 may be installed, or pushed into the receptacle 340 and the one or more release members 343 are configured to deflect out of the way and are biased back to their undeflected positions, where they engage the one or more catches (not shown) of the refill unit 150. In this manner, a refill unit 150 may be installed without opening cover 110.

In this exemplary embodiment, cover 110 encloses the lower portion of the refill unit 150 when it is installed in the dispenser 100. The fluid in refill unit 150 is placed in fluid communication with the pump (not shown) in a conventional method. An optional drip tray 108 is attached to the base 101 below the mounting portion 106 and the cover 110 to catch unused fluid dispensed from the refill unit 150.

Figure 4:
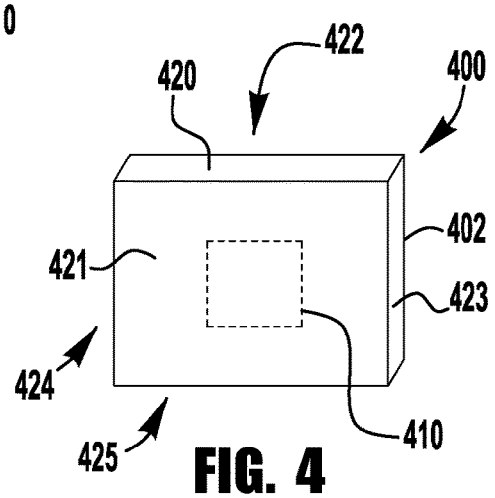
FIG. 4 is a perspective view an exemplary VOC.

Dispenser 100 includes a slot 380. Slot 380 is configured to receive a variable output card ("VOC") 400 (FIG. 4). VOC card 400 includes a housing 402. In this exemplary embodiment, housing 402 has a rectangular shape, however, other shapes may be used. Housing 402 has a top side 420, a front side 421, a back side 422, a right side 423 a left side 424 and a bottom 425. VOC card 400 includes memory 410. The memory 410 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, ROM, or the like, or combinations of different types of memory. In a preferred embodiment, the memory 410 is a radio frequency identification device ("RFID"). The memory 410, may be read wirelessly, or may be read through a hard connection or one or more contacts.

VOC card 400 fits into slot 380 in pump house 350. In this exemplary embodiment, VOC card 400 can only be removed when refill unit 150 is removed from dispenser 100. In some embodiments, once VOC card 400 is installed, VOC card 400 may not be removed from dispenser 100 without removing the pump house 350 from the dispenser 100. In some embodiments VOC card 400 is locked in place by a latch (not shown) that is connected to actuation member(s) 122 or release ring 211. Thus, to removed VOC card 400 from dispenser 100, a user needs to engage actuation member(s) 122 or release member 210/release ring 211 prior to being able to remove VOC card 400. In some embodiments, a hidden release member (not shown) may need to be engaged to remove VOC card 400. Preferably the top of VOC card 400 is flush with the top of slot 400. In some embodiments a tool (not shown) is needed to remove VOC card 400 from the dispenser 100. For example, the tool (not shown) may be configured to be able to grip a portion of the VOC card 400 that cannot be gripped with a persons fingers.

In some embodiments, VOC card slot 380 or VOC card receptacle, is located beneath the refill unit 150 when the refill unit 150 is installed in dispenser 100. In some embodiments, VOC card slot 380 is located behind the refill unit when the refill unit 150 is installed. In some embodiments, VOC card slot 380 is located behind the cover 110 when the cover 110 is closed and visible when the cover 110 is open. In some embodiments, VOC card slot 380 is located below the refill unit 150 and proximate the back of the refill unit 150.

In some embodiments, a second VOC card 400, or a hand-held device may be required to communicate with the dispenser 100 for VOC card 400 to be removed. For example, application on a smart phone may communicate with dispenser 100 via a Bluetooth® connection and instruct the dispenser 100 to eject VOC card 400. In some embodiments, VOC card 400 has a single side, e.g. top side 420 showing when it is inserted into the slot 380 in pump house 350. In some embodiments, VOC card 400 is hidden behind a door (not shown).

VOC card 400 includes data or information indicative of a dispense dose volume in memory 410. The information may be, for example, pump run time, number of pump revolutions, number of motor revolutions, a pump run time/voltage curve that allows the processor (not shown) in dispenser 100 to adjust the run time based upon the voltage to provide a consistent output. The VOC card 400 may be read by a reader (not shown) as described below. In some embodiments, memory 410 on VOC card 400 is read wirelessly. In some embodiments, memory 410 on VOC card 400 is a radio frequency identification device (RFID) and the reader is an RFID reader. In some embodiments, VOC card 400 has contacts and the reader (not shown) has mating contacts and the reader places the VOC card 400 in circuit communication with the processor (not shown) through a wired connection. In some embodiments, the reader (not shown) is configured to wirelessly read data from the VOC card 400 and read data from a separate, optional, data tag 621 located on refill unit 150.

Data tag 621 may also be referred to as an electronic key. Data tag 621 may be read wirelessly, by for example, reader 623. Data tag 621 includes data specific to the refill unit 610, such as, for example, authorized distributor information, manufacture information, lot number, expiration dates, fluid contents, volume of refill unit, type and or size of pump (if a pump is provided with the refill unit), refill expiration date, current volume, and the like. In some embodiments, data tag 621 may also include desired motor or pump speed information.

Thus, in some embodiments, dispenser 600 has a single reader 623 that is positioned and/or configured to read data from two separate data sources, VOC card 624 and data tag 621. As described herein, VOC card 624 includes data that is used to set the volume output of the dispenser 600. In some embodiments, data tag 621 includes data that may be used to set the volume output of dispenser 600. In some embodiments, if no VOC card 624 is inserted in the dispenser 600, the data on data tag 621 is used to set the output volume, however, if a VOC card 624 is installed, the processor uses the data on VOC card 624 to set the output volume, essentially overriding any volume output data on the data tag 621.

In some embodiments, different VOC cards 400 are color coded. For example, a blue color may be for a full size dose, of for example, 2 milliliters. A red color may be a smaller dose size, such as, for example 1.5 milliliters. A yellow color may be for the smallest dose size, such as, for example, 1 milliliters. Thus, a facility such a, for example, a grade school, may securely adjust the dispenser dispense volume based upon the anticipated use. For example, in areas that small children will likely use the dispenser, such as the kids bathroom, a yellow VOC card 400 may be inserted in the dispensers. In areas that will be used by the teachers, such as, for example, the teachers lounge or teachers bathroom, a blue VOC card 400 may be installed in those dispenser.

Some VOC cards 400 may be specifically designated for selected industries. A first VOC card may be a hospital VOC card and may be set for, for example, 2.0 milliliters. A second VOC card may be for factories and may be set at, for example, 2.5 milliliters. A third VOC card may be for office settings, and set at, for example 1.0 milliliters.

In some embodiments, if no VOC card 400 is insert in slot 380, the dispenser 100 defaults to a preset volume, of for example, 1.5 milliliter.

In some embodiments, VOC card 400 increases or decreases the preset volume. For example, in some embodiments VOC card 400 is a +0.5 milliliter and the preset volume is 1.5 milliliters, accordingly when the VOC card 400 is inserted in the dispenser, the dispenser will dispense 2.0 milliliters (1.5+0.5). VOC card 400 may increase or decrease the preset volume by any amount. In some embodiments, VOC card 400 is a +0.5 milliliter VOC card. In some embodiments, VOC card 400 is a +1.0 milliliter VOC card. In some embodiments, VOC card 400 is a +1.5 milliliter VOC card. In some embodiments, VOC card 400 is a −0.5 milliliter VOC card. In some embodiments, VOC card 400 is a −1.0 milliliter VOC card. In some embodiments, VOC card 400 is a −1.5 milliliter VOC card.

Figure 6:
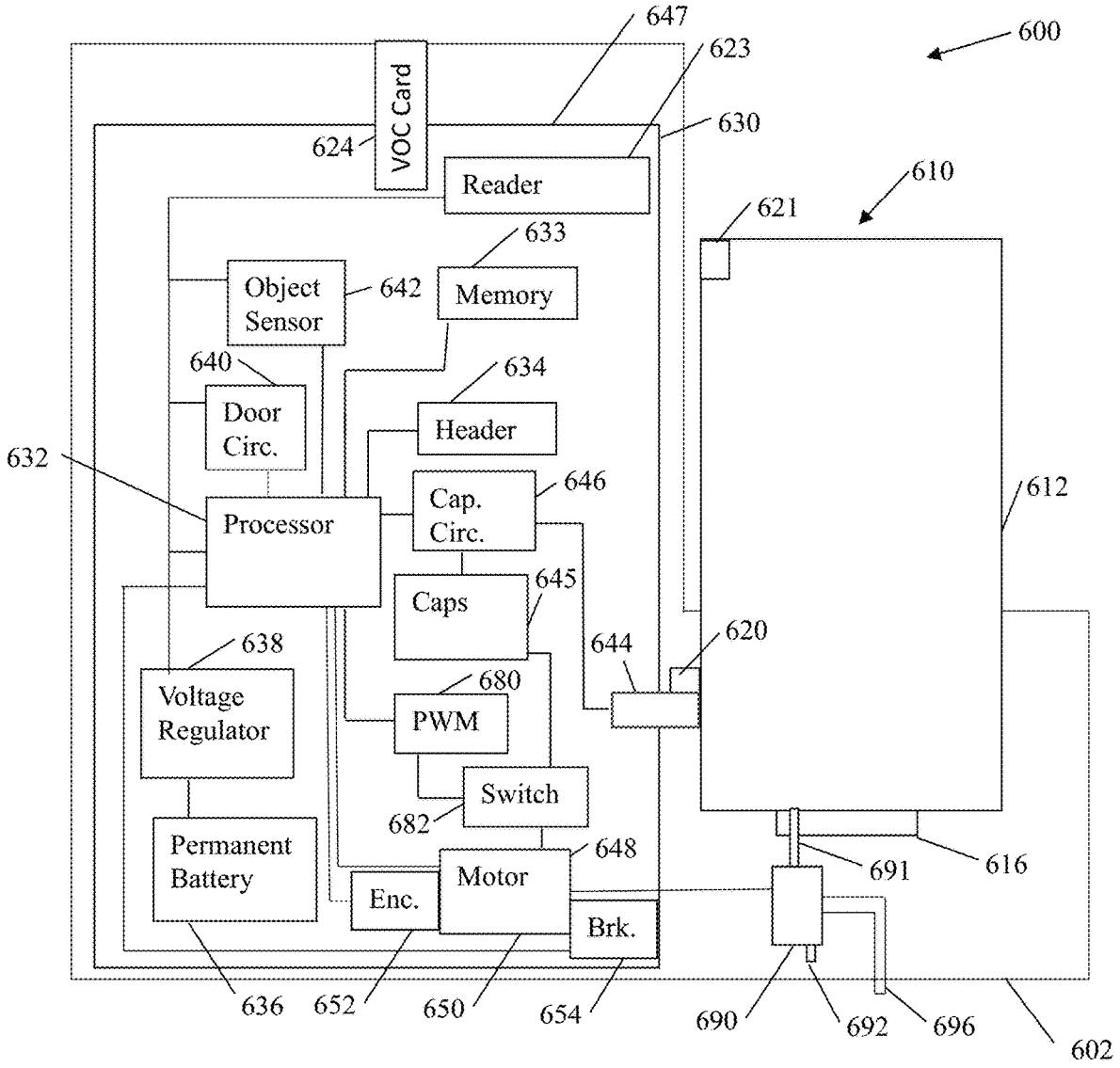
FIG. 6 is a generic illustrative schematic of an exemplary dispenser.

FIG. 6 illustrates an exemplary dispenser 600. Dispenser 600 includes a housing 602. Housing 602 may completely surround the components described herein and refill unit 610. In some embodiments, housing 602 surrounds a portion of the refill unit 610 as illustrated. In some embodiments, housing 602 does not surround the refill unit 610. Located within housing 602 is system circuitry 630. System circuitry 630 may be on a single circuit board or may be on multiple circuit boards. In addition, some of the system circuitry 630 may not be on a circuit board, but rather individually mounted and electrically connected to the other components as required. In this embodiment, system circuitry 630 includes a processor 632, memory 633, a header 634, a permanent power source 636, a voltage regulator 638, cover switch circuitry 640, an object sensor 642, a motor 648, a bank of capacitors 645, capacitor control circuitry 646, replaceable power source interface receptacle 644, pulse with modulation circuitry 680 and switching device 682, a motor encoder 650 and an optional break 650. Motor 648 drives a pump 690.

In this exemplary embodiment, pump 690 is a sequentially activated rotary diaphragm foam pump, such as, for example, those identified below and incorporated herein. In this exemplary embodiment, pump 690 is a permanent pump and remains secured to the dispenser housing 602. In this exemplary embodiment, pump 690 is a foam pump and draws air in through air inlet 692 and liquid in from liquid inlet 691 when a refill unit 610 is mounted in the dispenser 600. Pump 690 has a foam outlet 696 to dispense foam out of the dispenser 600. In some embodiments, pump 190 is a liquid pump and does not require the air inlet 692. In some embodiments, pump 690 is part of the refill unit 610 and is removed and replaced with the refill unit 610. In some embodiments, the refill unit 610 is replaced with a permanent or semi-permanent container (not shown) that is refilled periodically and not removed and replaced. In this exemplary embodiment, dispenser 600 includes an optional encoder 652 and optional brake 654.

Dispenser 600 includes a reader 623. When VOC card 624 is inserted in dispenser 600, reader 623 can read the data stored in the VOC card 624. The data is indictive of the volume of fluid to be dispensed from the dispenser, as described in more detail above. VOC card 624 includes memory containing data that may be communicated to the processor 632 through reader 623. The memory may be any type of memory and the circuit communications with processor may be wireless or wired communications. In a preferred embodiment, the memory in VOC card 624 is a Radio Frequency Identification Device ("RFID") and preferably a read/write RFID. In some embodiments, reader 623 is positioned and/or configured to read data from VOC card 624 and to also read data from a data tag 631.

Exemplary touch-free dispensers are shown and described in U.S. Pat. No. 7,837,066 titled Electronically Keyed Dispensing System And Related Methods Utilizing Near Field Response; U.S. Pat. No. 9,172,266 title Power Systems For Touch-Free Dispensers and Refill Units Containing a Power Source; U.S. Pat. No. 7,909,209 titled Apparatus for Hands-Free Dispensing of a Measured Quantity of Material; U.S. Pat. No. 7,611,030 titled Apparatus for Hands-Free Dispensing of a Measured Quantity of Material; U.S. Pat. No. 7,621,426 titled Electronically Keyed Dispensing Systems and Related Methods Utilizing Near Field Response; and U.S. Pat. No. 8,960,498 titled Touch-Free Dispenser with Single Cell Operation and Battery Banking; all of which are incorporated herein by reference in their entirety. Various components of one or more of the disclosed features or components may be used in the inventive dispensers. In addition, in some embodiments, sequentially activated diaphragm pumps are utilized in the touch free dispensers. Exemplary sequentially activated diaphragm pumps and associated dispensers are shown and described in U.S. Pat. Nos. 9,943,196, 10,065,199, 10,080,466, 10,080,467, 10,143,339, and 10,080,468, which are incorporated herein in their entirety by reference.

Processor 632 may be any type of processor, such as, for example, a microprocessor or microcontroller, discrete logic, such as an application specific integrated circuit (ASIC), other programmed logic device or the like. Processor 632 is in circuit communication with header 634. Header 634 is a circuit connection port that allows a user to connect to system circuitry 630 to program the circuitry, run diagnostics on the circuitry and/or retrieve information from the circuitry. In some embodiments, header 634 includes wireless transmitting/receiving circuitry, such as for example, wireless RF, BlueTooth®, ANT®, or the like, configured to allow the above identified features to be conducted remotely.

Processor 632 is in circuit communication with memory 633. Memory 633 may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, ROM, or the like, or combinations of different types of memory. In some embodiments, the memory 633 is separate from the processor 632, and in some embodiments, the memory 633 resides on or within processor 632.

An optional permanent power source 636, such as, for example, one or more batteries, is also provided. The permanent power source 636 is preferably designed so that the permanent power source 136 does not need to be replaced for the life of the dispenser 600. The permanent power source 636 is in circuit communication with voltage regulator circuitry 638. In one exemplary embodiment, voltage regulator circuitry 138 provides regulated power to processor 632, object sensor 642, end of stroke detection circuitry 647 and door circuitry 140. Permanent power source 636 may be used to provide power to other circuitry that requires a small amount of power and will not drain the permanent power source 636 prematurely. In the event, no permanent power source is used, or optionally even with a permanent power source, the voltage regulatory circuit 638 be connected to another source of power.

Processor 632 is also in circuit communication with optional cover circuitry 640 so that processor 632 knows when the dispenser 600 cover (not shown) is closed. In some embodiments, the cover is a conventional cover that opens up by either sliding with respect to the dispenser housing, or swings away from the dispenser housing at one or more hinge points, to remove and replace the refill 610 or refill a container. In some embodiments, the "cover" is merely a part of the dispenser that may be opened to access the electronics, and/or to remove and replace refill units 610. In some embodiments, processor 632 will not allow the dispenser 600 to dispense a dose of fluid if the cover is open. Cover circuitry 640 may be any type of circuitry, such as, for example, a mechanical switch, a magnetic switch, a proximity switch or the like. Processor 632 is also in circuit communication with an object sensor 642 for detecting whether an object is present in the dispense area. Object sensor 642 may be any type of passive or active object sensor, such as, for example, an infrared sensor and detector, a proximity sensor, an imaging sensor, a thermal sensor or the like.

In addition, processor 632 is in circuit communication with pulse width modulation circuitry 680. Pulse width modulation circuitry 680 is in circuit communication with switching device 682. In this exemplary embodiment, switching device 682 is in circuit communication with capacitor bank 645 and motor 648. In some embodiments, switching device 682 is in circuit communication with a different power source (not shown) alone or in combination with the optional capacitor bank 645. In some embodiments, capacitor bank 645 is replaced with one or more regular batteries, and/or one or more rechargeable batteries. During operation, processor 632 provides one or more signals to pulse width modulation circuitry 680, which cause pulse width modulation circuitry 680 to control switching device 682 to modulate the power provided by capacitors 645 to drive the motor 648. More detailed descriptions of the modulated power signals are described in U.S. Pat. Pub. No. 2019/0133384 titled Touch-Free Dispenser and US 2017/0049276 titled Power Systems for Dynamically Controlling a Soap, Sanitizer or Lotion Dispenser Drive Motor. Both of which are incorporated herein by reference in their entirety.

Motor 648 (and any associated gearing) operate foam pump 690 (which may be a liquid pump in some embodiments). In this exemplary embodiment, dispenser 600 includes an encoder 652. Encoder 652 may be, for example, an optical encoder. In some embodiments, encoder 652 provides an output to processor 632 at least about 4 times per revolution of the motor. In some embodiments, encoder 652 provides an output to processor 632 at least about 8 times per revolution of the motor. In some embodiments, encoder 652 provides an output to processor 632 at least about 16 times per revolution of the motor. In some embodiments, encoder 652 is an 4-slot optical encoder. In some embodiments, encoder 652 is an 8-slot optical encoder. In some embodiments, encoder 652 is a 16-slot encoder. Encoder 652 is used to accurately count the rotations and/or fractions thereof of the motor 652.

In this exemplary embodiment, dispenser 600 also includes an optional brake 654. Optional brake 654 may be used to stop the motor 652 after the required dose size has been dispensed. Absent a brake 654, the motor 652 may continue to rotate (or free-wheel) and cause more fluid to be dispensed then desired. In addition, various factors may affect the amount of free-wheel rotation, such as, for example, motor speed, vacuum pressure in the fluid container 612, drive voltages and the like. Accordingly, the amount of free-wheel travel may differ from dispense to dispense. Use of an optional brake 654 may help to eliminate the variations in volume dose sizes between individual dispenses.

Refill unit 610 is readily inserted into dispenser 600 and removed from dispenser 600 as a unit. Refill unit 610 includes a container 612 and a closure 616. In some embodiments, container 612 is a non-collapsing container and a vent (not shown) is included in closure 616 to allow air to flow into the container and prevent collapsing of container 612. In some embodiments, container 612 is a collapsible container and collapses as fluid if removed from the container 612. In some embodiments, refill unit 610 also includes a foamable liquid 613, such as, for example, a foamable soap, sanitizer, lotion, moisturizer or other liquid used for personal hygiene. In some embodiments, refill unit 610 is for use in a liquid dispenser, rather than a foam dispenser, and filled with liquid that is not foamed or may not be foamable.

In addition, in in some embodiments refill unit 610 includes an optional energy source 620. Energy source 620 may be any power source, such as, for example, a single "AA" battery, a coin cell battery, a 9 volt battery or the like. In some embodiments, the energy source 620 does not contain enough power to directly power motor 652 (and associated gearing) to dispense the contents of the refill unit 610. Energy source 620 is inserted into dispenser 600 with refill unit 610 and is removed from dispenser 600 with refill unit 610. In some embodiments, refill unit 610 does not have a power source and the dispenser 600 receives sufficient power to dispense the contents of refill unit 610 without receiving power from the refill unit 610.

In this exemplary embodiment, system circuitry 630 also includes a bank of capacitors 645 and capacitor control circuitry 646 in circuit communication with processor 632. The bank of capacitors 645 and capacitor control circuitry 646 is in circuit communication with replaceable power source interface receptacle 644 and actuator drive 648. Replaceable power source interface receptacle 644 is configured to receive and/or otherwise electrically couple with replaceable energy source 620 when refill unit 610 is inserted in the dispenser 600. In some embodiments, the capacitors and capacitor circuitry are replaced with one or more batteries. The batteries may be rechargeable or non-rechargeable.

During operation, when a refill unit 610 is inserted into dispenser 600, processor 632 and capacitor control circuitry 646 cause the bank of capacitors 645 to charge in parallel. In one exemplary embodiment, there are two or more capacitors. In some embodiments the capacitors are oversized for the required power to power the motor 650 and associated gearing to dispense a dose of foam. Oversized capacitors are preferably charged to a level that is less than the rated voltage of the capacitors. Because the bank of capacitors 645 is charged to less than full capacity, there is less discharge in the capacitors when they are idle for a period of time. In some embodiments, the capacitors are charged to less than about 50% of their full capacity. In some embodiments, the capacitors are charged to less than about 75% of their full capacity. In some embodiments, the capacitors are charged to less than about 90% of their full capacity.

When the processor 632, through object sensor 642, determines that an object is within the dispense zone, the processor 632 causes the capacitor control circuitry 646 to place the capacitors 645 in series to provide power to switching device 682, the switching device 682 in coordination with the pulse width modulation circuitry 680 provide modulated power to power the motor 650 to operate foam pump 690. Once a dose has been dispensed, processor 632 checks the charge on the capacitors 645. If the charge is below a threshold, the processor 632 causes the capacitor control circuitry 646 to charge the capacitors 645. The capacitors 645 are charged in parallel.

Although the exemplary dispenser 600 is shown and described with capacitors as a power source, other types of power sources may be used, such as, for example, rechargeable batteries. Additional exemplary dispensers as well as more detail on the circuitry for the touch free dispenser described above is more fully described and shown in U.S. patent application Ser. No. 13/770,360 titled Power Systems for Touch Free Dispensers and Refill Units Containing a Power source, filed on Feb. 19, 2013 which is incorporated herein by reference in its entirety.

In some embodiments, the processor 632 monitors the amount of fluid left in the refill unit 610. The processor 632 may monitor the amount of fluid by detecting the fluid level, for example, with a level sensor, with a proximity sensor, with an infrared detection, by accumulating the volume of fluid dispensed and comparing that to a total volume for the refill unit or the like. When the processor 632 determines that the refill unit 610 is empty, or close to being empty, the processor 632 causes the replaceable energy source 620 to charge the capacitors 645 up to their maximum charge, or to charge the capacitors 645 up until the replaceable energy source 620 is completely drained or drained as far as possible. Thus, when the refill unit 610 and replaceable energy source 620 is removed, as much energy as possible has been removed from the replaceable energy source 620.

Exemplary methodologies and logic diagrams are provided herein. Unless otherwise noted, additional blocks or steps may be included, fewer blocks or steps may be used, the blocks or steps may be performed in different orders, and one or more blocks from one methodology or logic diagram may be incorporated into the other methodologies or block diagrams. One of ordinary skill in the art may use the logic diagrams and or methodologies to program the dispenser so that the processor controlled dispenser may perform functions described herein.

Figure 7:
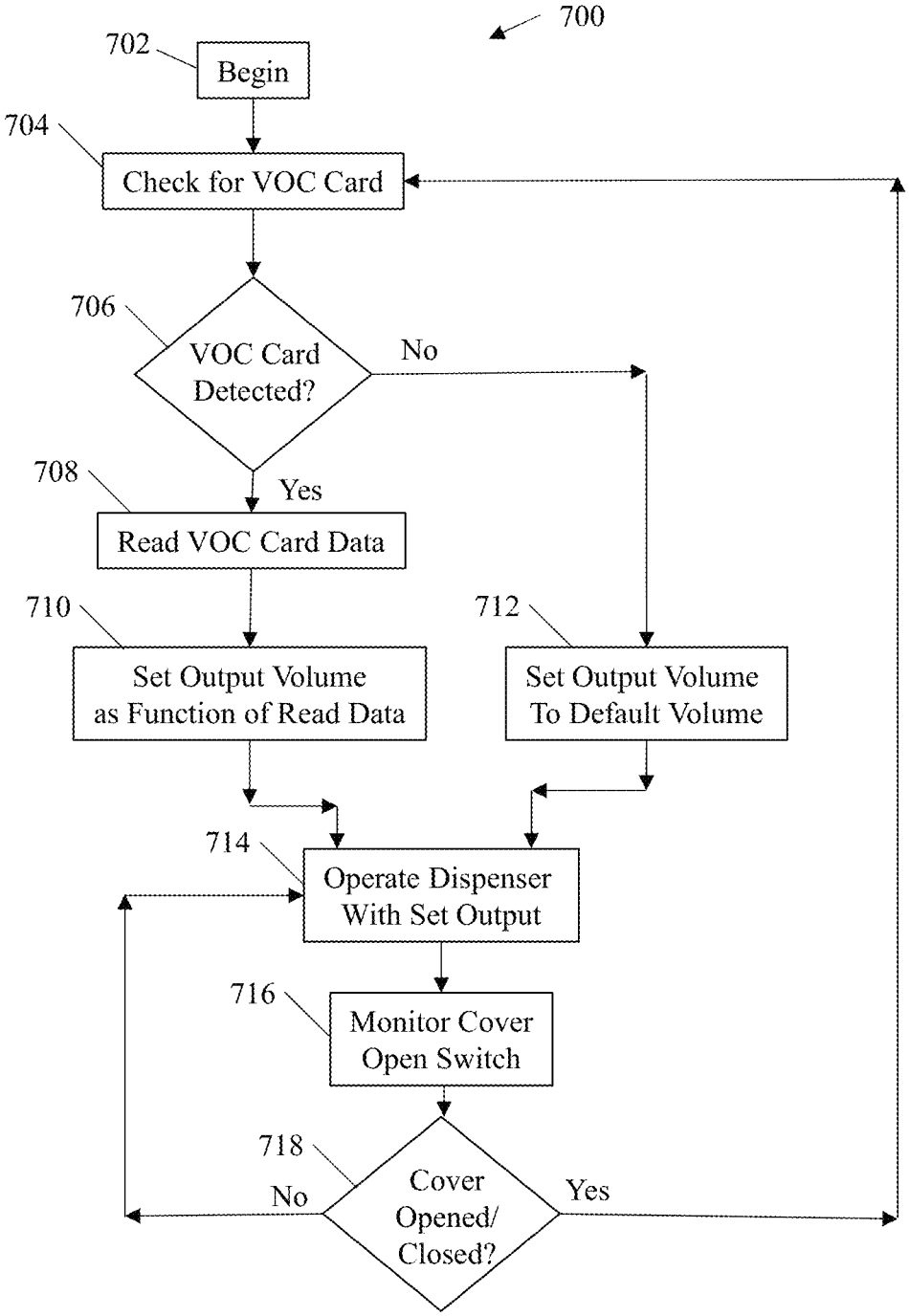
FIG. 7 is an exemplary methodology or logic flow diagram for using a VOC to securely control the output volume size of a dispenser.

FIG. 7 is an exemplary methodology or logic diagram 700 for use of a VOC card in a dispenser. The methodology begins at block 702. At block 704 the processor causes the system to check for a VOC card. A VOC card may be detected by any method, such as, for example, a switch being engaged when the VOC card is installed, the processor attempting to read data from the VOC card and if data is present the VOC card is present, or any other manor for determining whether a VOC card has been detected. At block 706, a determination is made as to whether the VOC card has been detected. If no VOC card is detected, the methodology flows to block 712 and the output of the dispenser is set to a default volume. In some embodiments the default volume is a 3 milliliter ("ml") output. In some embodiments the default volume is a 2.5 ml output. In some embodiments the default volume is a 2 ml output. In some embodiments the default volume is a 1.5 ml output. In some embodiments the default volume is a 1.0 ml output. In some embodiments the default volume is a 0.5 ml output. In some embodiments the default volume is no output. In the final example, the dispenser does not dispense any output if the VOC card has been removed from the dispenser.

If the VOC card is detected at block 706, the data from the VOC card is read at block 708. If the detection of the VOC card was made by attempting to read data from the VOC card, the data may have been read at block 706. At block 701, the output volume is set as a function of the data read from the VOC card. The data may be one or more volumes, one or more pump run times, one or more increments or decrements, or the like.

After the output volume is set, the methodology flows to block 714 and the dispenser proceeds to operate in its normal fashion using the set dispense rate. In this exemplary methodology, the refill unit is located in a position that the VOC card cannot be removed or inserted when a refill unit is installed in the dispenser. Accordingly, once the volume is set at block 710 or 712, the processor does not need to continually check to see if a VOC card has been removed or installed. As a result, in this exemplary methodology, the processor monitors whether the cover closed/open switch is activated at block 716. To remove/replace a refill unit, in this exemplary methodology, the cover must be opened. If the cover is opened and closed, the methodology loops back to block 704. If the cover has not been opened/closed, the methodology loops bac to block 714.

An exemplary method of adjusting the output volume of a touch-free dispenser includes providing a touch-free dispenser that has a variable output control card receptacle, a card reader for reading data from the variable output control card, a receptacle for receiving a refill container, a cover, a processor, and memory. Logic is stored in the memory for causing the processor to read data from a variable output control card. Logic is also stored in the memory for setting a dispenser output volume as a function of the data read from the variable output card. The method further comprises providing a refill unit and providing a variable output control card to be inserted in the variable output control card receptacle. The variable output card is separate from the refill unit and wherein the variable output card remains in the dispenser when the refill unit is removed from the dispenser. The method further includes causing a reader to read data from the variable output control card and causing the output volume of the dispenser to be set as a function of the data read from the variable output control card.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. It is not the intention of the applicant to restrict or in any way limit the scope of the appended claims to such detail. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order in which the steps are presented to be construed as required or necessary unless expressly so stated.

We claim:

1. A touch-free soap, sanitizer or lotion dispenser comprising:
- a housing;
- a movable cover;
- a processor;
- dispenser memory;
- a refill receptacle;
- a removable and replaceable refill unit having a data tag secured thereto;
- wherein the data tag comprises data tag memory;
- a variable output control card receptacle;
- a variable output control card;
- wherein the variable output control card is configured to be removed without removing the dispenser memory;
- variable output control card memory located on the variable output control card;
- one or more readers for placing the processor in circuit communication with the variable output control card memory and in circuit communication with the refill unit data tag memory;
- a sensor for sensing an object;
- wherein data on the variable output control card memory is used to set a dispenser output volume irrespective of the dispenser output volume stored in the data tag memory.

2. The touch-free dispenser of claim 1 wherein the data tag contains data indicative of the dispenser output volume.

3. The touch-free dispenser of claim 1 wherein the variable output control card remains in the dispenser when the refill unit is removed from the dispenser.

4. The touch-free dispenser of claim 1 wherein the variable output control card cannot be removed when the refill unit is installed in the dispenser.

5. The touch-free dispenser of claim 1 wherein the variable output control card receptacle is located beneath the refill unit when the refill unit is installed in the dispenser.

6. The touch-free dispenser of claim 1 wherein the variable output control card receptacle is located behind the refill unit when the refill unit is installed in the dispenser.

7. The touch-free dispenser of claim 1 wherein the processor reads the data on the variable output card each time the cover is moved from an open position to a closed position.

8. The touch-free dispenser of claim 1 wherein the variable output control card is rectangular.

9. The touch-free dispenser of claim 1 wherein the variable output control card is at least partially surrounded by the variable output control card receptacle.

10. The touch-free dispenser of claim 1 wherein the variable output control card receptacle is a slot.

11. The touch-free dispenser of claim 1 wherein a single reader reads the data from the variable output card and reads the data tag on the refill unit.

12. The touch-free dispenser of claim 1 further comprising a logic stored on the dispenser memory for setting the dispenser output volume.

13. The touch-free dispenser of claim 1 wherein the data on the variable output control card memory causes a decrease in a preset volume by a set amount.

14. The touch-free dispenser of claim 1 wherein data on the variable output control card memory causes an increase in a preset volume by a set amount.

15. The touch-free dispenser of claim 1 further comprising a second variable output control card.

16. The touch-free dispenser of claim 15 wherein a first variable output control card has a first color code and the second variable output card has a second color code.

17. A touch-free soap, sanitizer or lotion dispenser comprising:
- a housing;
- a movable cover;
- a processor;
- dispenser memory;
- a refill receptacle;
- a variable output control card receptacle;
- a variable output control card;
- wherein the variable output control card is configured to be removed without removing the dispenser memory;
- variable output control card memory located on the variable output control card;
- a reader for placing the processor in circuit communication with the variable output control card;
- data on the variable output control card for adjusting a dispenser output volume;
- wherein the variable output control card remains in the dispenser when a refill unit is removed from the dispenser; and
- a sensor for sensing an object.

18. The touch-free dispenser of claim 17 wherein the variable output control card receptacle is located beneath the refill unit when the refill unit is installed in the dispenser.

19. The touch-free dispenser of claim 17 wherein the variable output control card receptacle is located behind the refill unit when the refill unit is installed in the dispenser.

20. The touch-free dispenser of claim 17 further comprising a second variable output control card.

21. The touch-free dispenser of claim 20 wherein a first variable output control card has a first color code and the second variable output card has a second color code.

22. The touch-free dispenser of claim 17 wherein the processor reads the data from the variable output card memory after the cover is moved from an open position to a closed position.

23. The touch-free dispenser of claim 17 further comprising a pump located in the housing, wherein the pump remains with the dispenser when the refill unit is removed from the dispenser.

24. The touch-free dispenser of claim 23 wherein the pump is a sequentially activated diaphragm pump.

25. The touch-free dispenser of claim 24 wherein the pump is a foam pump.

26. The touch-free dispenser of claim 17 wherein the variable output control card is rectangular.

27. The touch-free dispenser of claim 17 wherein the variable output control card is at least partially surrounded by the variable output control card receptacle.

28. The touch-free dispenser of claim 17 wherein the variable output control card receptacle is a slot.

29. The touch-free dispenser of claim 17 wherein the housing comprises a receptacle for engaging with a battery connected to the refill unit and wherein the receptacle allows for transfer of power from the battery to the dispenser.

30. The touch-free dispenser of claim 17 further comprising logic stored on the dispenser memory for setting a preset dispense output volume.

31. The touch-free dispenser of claim 17 further comprising logic stored on the variable output control memory for decreasing a preset volume by a set amount.

32. The touch-free dispenser of claim 17 further comprising logic stored on the variable output control memory for increasing a preset volume by a set amount.

33. A touch-free soap, sanitizer or lotion dispenser comprising:

a housing;

a movable cover;

a processor;

memory;

logic stored in the memory for causing a default dispense dose volume to be dispensed upon actuation of the dispenser;

a variable output control card receptacle;

wherein the variable output control card receptacle is configured to have a variable output control card removed from the variable output control card receptacle without removing the dispenser memory;

a card reader for placing the processor in circuit communication with the variable output control card;

a refill receptacle for receiving a refill unit of fluid;

a sensor for sensing an object;

a logic stored in the memory;

the logic causing the processor to read data from the variable output control card memory when the variable output control card is located in the variable output control card receptacle;

the logic for causing the processor to set a dispenser output volume as a function of the data read from the variable output control card and to override the default dispense dose volume;

wherein when the refill unit is removed, the variable output control card remains with the dispenser.

34. The touch-free dispenser of claim 33 further comprising the variable output control card inserted in the variable output control card receptacle, wherein the variable output control card further comprises variable output control card memory continuing data indicative of the dispenser output volume.

35. The touch-free dispenser of claim 34 wherein, when the variable output control card cannot be removed from the dispenser when the refill unit is installed in the dispenser.

36. The touch-free dispenser of claim 33 wherein the card reader is a wireless card reader.

37. The touch-free dispenser of claim 33 wherein the card reader places the processor in circuit communication through a wired connection.

38. The touch-free dispenser of claim 33 wherein the variable output control card receptacle is located behind the refill receptacle.

39. The touch-free dispenser of claim 33 wherein the variable output control card receptacle encloses at least three sides of the variable output control card when the variable output control card is inserted in the dispenser.

40. The touch-free dispenser of claim 33 wherein the variable output control card is an industry specific variable output control card.

41. The touch-free dispenser of claim 34 wherein the variable output control card has a color indicator, wherein the color indicator is indicative of a volume dose size.

42. A method of adjusting the output volume of a touch-free dispenser comprising:

providing a touch-free dispenser that has a variable output control card receptacle;

a card reader for reading data from a variable output control card;

a receptacle;

a cover;

a processor;

dispenser memory; and logic stored in the dispenser memory for setting a first dispenser output volume;

providing a refill unit;

inserting the variable output control card in the variable output control card receptacle;

wherein the variable output card is separate from the refill unit and separate from the dispenser memory; and wherein the variable output card remains in the dispenser when the refill unit is removed from the dispenser;

causing the processor to read the data from the variable output control card;

causing the processor to set a second dispenser output volume as a function of the data read from the variable output card that is different than the first dispenser output volume.

43. The method of claim 42 further providing the refill unit having a data tag and causing the card reader to read data from the data tag.

44. The method of claim 42 wherein the card reader is a wireless card reader.

45. The method of claim 42 wherein the card reader places the processor in wired circuit communications with the variable output control card.

* * * * *